US010167646B1

(12) United States Patent
Sirco et al.

(10) Patent No.: US 10,167,646 B1
(45) Date of Patent: Jan. 1, 2019

(54) POOL, METHOD OF FABRICATING A POOL, AND A POOL PANEL JUNCTION

(71) Applicant: Trojan Leisure Products, LLC, Albany, NY (US)

(72) Inventors: Collin J. Sirco, Ballston Lake, NY (US); David A. Steele, Gansevoort, NY (US); Stephen E. Deeb, Selkirk, NY (US)

(73) Assignee: Trojan Leisure Products, LLC, Albany, NY (US)

( * ) Notice: Subject to any disclaimer, the term of this patent is extended or adjusted under 35 U.S.C. 154(b) by 65 days.

(21) Appl. No.: 15/169,392

(22) Filed: May 31, 2016

(51) Int. Cl.
*E04H 4/00* (2006.01)

(52) U.S. Cl.
CPC ..... *E04H 4/0043* (2013.01)

(58) Field of Classification Search
CPC ..... E04H 4/0043; E04H 4/005; E04H 2004/0068; E04H 4/0087; E04H 4/0093; E04H 4/145; E04H 4/144
See application file for complete search history.

(56) References Cited

U.S. PATENT DOCUMENTS 5,010,699 A 4/1991 Maiuccoro et al.
5,086,595 A 2/1992 Maiuccoro et al.
5,720,056 A * 2/1998 Aymes ..... E04H 4/005 4/488
5,752,350 A 5/1998 Maiuccoro
D431,303 S 9/2000 Maiuccoro
8,266,845 B2 * 9/2012 Desjoyaux ..... E04H 4/0062 256/19
8,950,155 B2 2/2015 Maiuccoro
9,080,338 B2 7/2015 Maiuccoro
2007/0039091 A1 * 2/2007 Foy ..... A47K 3/006 4/488
2008/0104745 A1 * 5/2008 Beaudoin ..... E04C 2/292 4/506

OTHER PUBLICATIONS

Radiant Pool's "Inground Pool Installation Manual" (Apr. 2014), 28 pages.
Imperial Pools Royal Specbook, 2004, 101 pages.
Imperial Pools Royal Component Book, 2004, 41 pages.

* cited by examiner

*Primary Examiner* — Janie Loeppke
(74) *Attorney, Agent, or Firm* — Tech Valley Patent, LLC; John Pietrangelo

(57) ABSTRACT

Pools, methods of fabricating pools, and pool panel junctions are provided. The pool includes a first internal surface having a first radius; a second internal surface, for example, of a wading pool, having a second radius; a third internal surface having a third radius, different from the second radius; and a junction where the first internal surface transitions to the second internal surface at a first elevation and the first internal surface transitions to the third internal surface at a second elevation, different from the first elevation. The pool panel junction includes at least one elongated member having a pair of opposing sides defining planes that converge at an apex, such as, a triangular member, and wherein each of the opposing sides is adapted to engage an adjacent connector operatively mounted to a pool panel. An elongated pool panel structural member and a method of fabricating a pool are also provided.

23 Claims, 10 Drawing Sheets

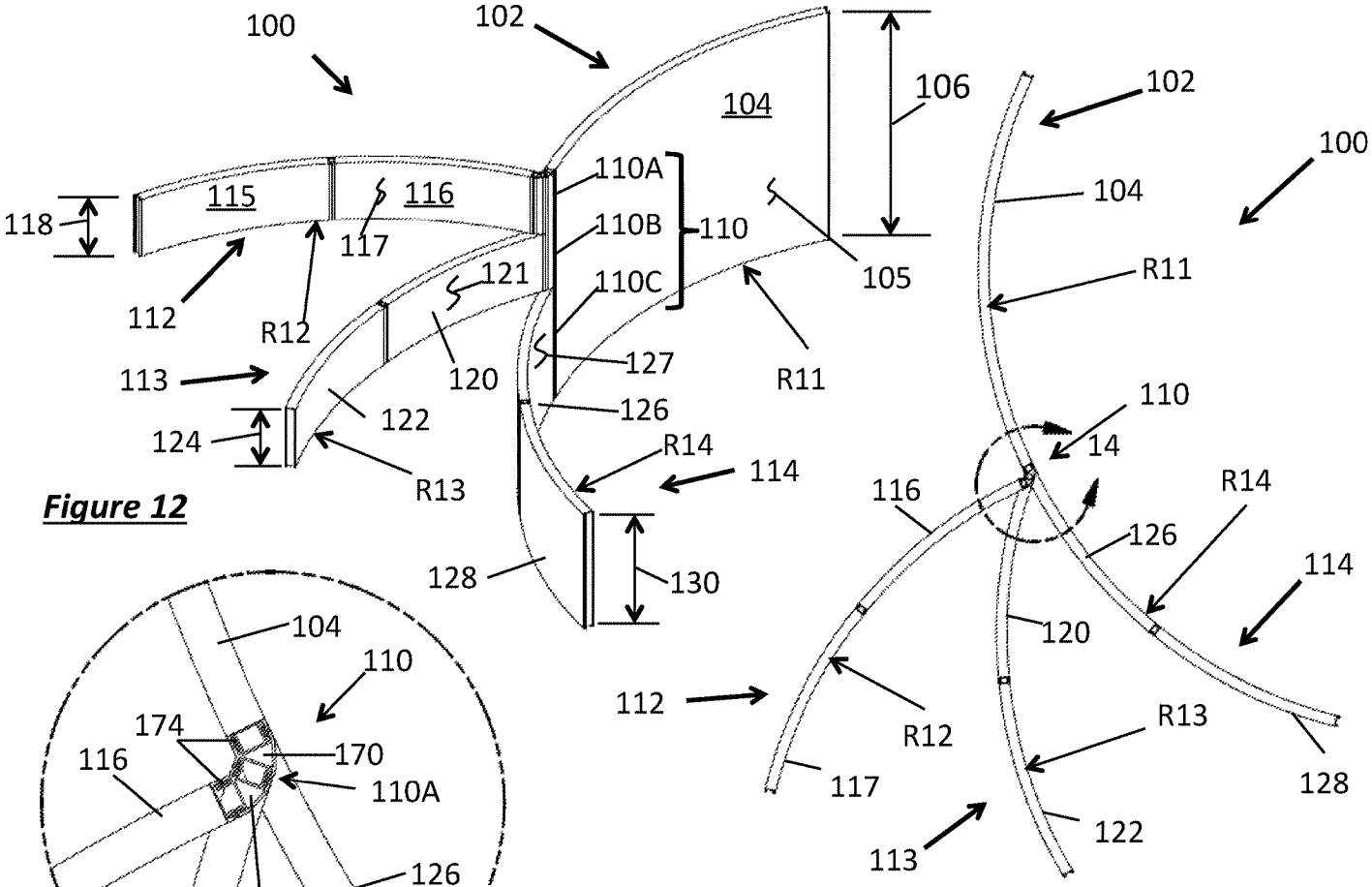
Figure 12
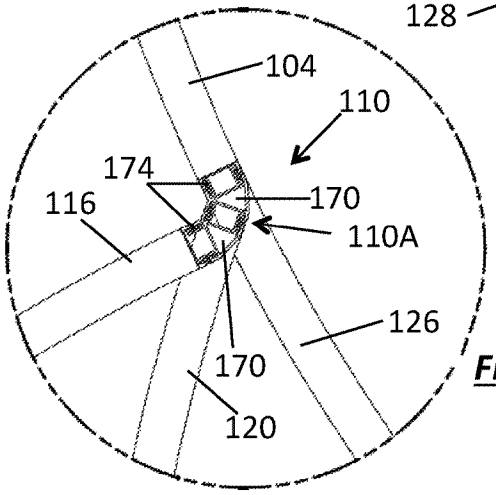
Figure 14
Figure 13

POOL, METHOD OF FABRICATING A POOL, AND A POOL PANEL JUNCTION

BACKGROUND OF THE INVENTION

Technical Field

Embodiments of the present invention generally relate to pool construction, for example, swimming pool construction. More particularly, embodiments of the present invention relate to methods and devices for fabricating pool walls or surfaces using specially designed junctions and support members that are uniquely adapted to accommodate variations in the depth of the pool.

Description of Related Art

Inground and above-ground swimming pool design and construction continuously improve to accommodate customer desires for new and unique pool constructions and aesthetic appearance. Contemporary pool designs are highly engineered to accommodate the needs of the customer and to address market and economic trends for enhanced functionality and appearance while reducing costs of fabrication, servicing, and maintenance, while enhancing the overall bathing experience.

The use of insulated pool panels in the construction of inground and above-ground pools and related structures is one such advancement in the field. Insulated pool panels are specially designed to retain heat within the pool and reduce pool water heating costs, among other advantages. Unlike poured concrete or gunite pools, insulated panel pool design facilitates pool construction and minimizes servicing and maintenance by the user. In addition, insulated panel pool design provides unique opportunities for pool construction and appearance that would otherwise not be possible.

One of the current trends in pool construction is the preference for "wading pools" contiguous with the main pool. These wading pools are typically shallow portions of the pool where the bather can sit or lounge in the shallow water, for example, in a lounge chair. However, these shallow wading areas can provide a challenge to pool designers, for example, to provide structurally sufficient and atheistically pleasing junctions in the pool construction between the main portion of the pool and the shallower wadding portion.

Aspects of the present invention further enhance the benefits and advantages of insulated panel pool construction by, among other things, accommodating pool designs having wading sections without detracting from the construction and over-all appearance of the pool.

SUMMARY OF THE INVENTION

Embodiments of the present invention, in their many aspects, provide improved pool construction and opportunities for unique pool design. Though aspects of the present invention may be applicable to any form of pool construction, for example, pools having a concrete and/or metallic substructure, other aspects of the invention are uniquely adapted for use with pools fabricated with pool panels.

One embodiment of the invention is a pool comprising or including: a first internal surface having a first radius; a second internal surface having a second radius; a third internal surface having a third radius, different from the second radius; and a junction where the first internal surface transitions to the second internal surface at a first elevation and the first internal surface transitions to the third internal surface at a second elevation, different from the first elevation. The second internal surfaced may be the internal surface of a wading pool. In one aspect, at least one of the first internal surface, the second internal surface, and the third internal surface comprises an internal surface of a pool panel.

In one aspect, the junction may include at least one elongated structural member adapted to operatively engage the first pool panel, and the second pool panel. The elongated structural member may have a length substantially equal to a depth of the second pool panel, for example, the depth of the contiguous wading pool. In one aspect, the elongated structural member comprises a pair of opposing sides defining planes that converge at an apex; for example, the elongated structural member may be triangular in cross section. In another aspect, the opposing sides of the triangular member may include a mechanical fastener, for example, a pair of opposing recesses, each of the recesses adapted to receive a projection from a connector, for example, an elongated spline having a pair of opposing projections.

Another embodiment of the invention is a method of fabricating a pool, the method comprising or including: forming a first internal surface having a first radius; mating a second internal surface having a second radius with the first internal at a junction at a first elevation; and mating a third internal surface having a third radius, different from the second radius, with the first internal surface at the junction at a second elevation different from the first elevation. In one aspect, forming the first internal surface having the first radius may be practiced by providing a first pool panel having the first radius; and wherein mating the second internal surface having the second radius with the first internal surface at the junction comprises providing a second pool panel having the second radius and mating the second pool panel with the first pool panel at the junction.

In another aspect of the invention, mating the second pool panel with the first pool panel at the junction may be practiced by inserting at least one elongated member having a pair of opposing sides defining planes that converge at an apex between the first pool panel and the second pool panel a the junction. In another aspect, mating the second pool panel with the first pool panel at the junction may be further practiced by operatively connecting the at least one elongated member with the first pool panel and the second pool panel. For example, operatively connecting the at least one elongated member with the first pool panel and the second pool panel may be practiced by slidably engaging a first elongated connector between the first pool panel and the at least one elongated connector and slidably engaging a second elongated connector between the second pool panel and the at least one elongated connector.

A further embodiment of the invention is a pool panel junction comprising or including at least one elongated member having a pair of opposing sides defining planes that converge at an apex, and wherein each of the opposing sides is adapted to engage an adjacent connector operatively mounted to a pool panel. In one aspect, the cross section of the at least one elongated member is triangular. In another aspect, each of the opposing sides adapted to engage the adjacent connector may include a pair of opposing recesses, wherein each of the pair of opposing recesses is adapted to slidably receive a projection from an elongated connector, for example, as spline. In another aspect, the pair of opposing sides defines an apex angle from 30 degrees to 60 degrees.

A further embodiment of the invention is an elongated pool panel structural member comprising or having a pair of opposing sides defining planes that converge at an apex; wherein each of the opposing sides adapted to engage an adjacent connector. In one aspect, the cross section of the member is triangular. In another aspect, each of the opposing sides adapted to engage the adjacent connector comprises a pair of opposing recesses, wherein each of the pair of opposing recesses is adapted to slidably receive a projection from an elongated connector, for example, a spline.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

FIG. 12 is a perspective view, similar to FIG. 4, of a portion of a pool having a surface junction according to another aspect of the present invention.

FIG. 13 is a top plan view of the portion of the pool shown in FIG. 12 according to one aspect of the invention.

FIG. 14 is a detailed top plan view of junction shown in FIG. 13 as identified by Detail 14 in FIG. 13 according to one aspect of the invention.

DETAILED DESCRIPTION OF THE INVENTION

Figure 1:
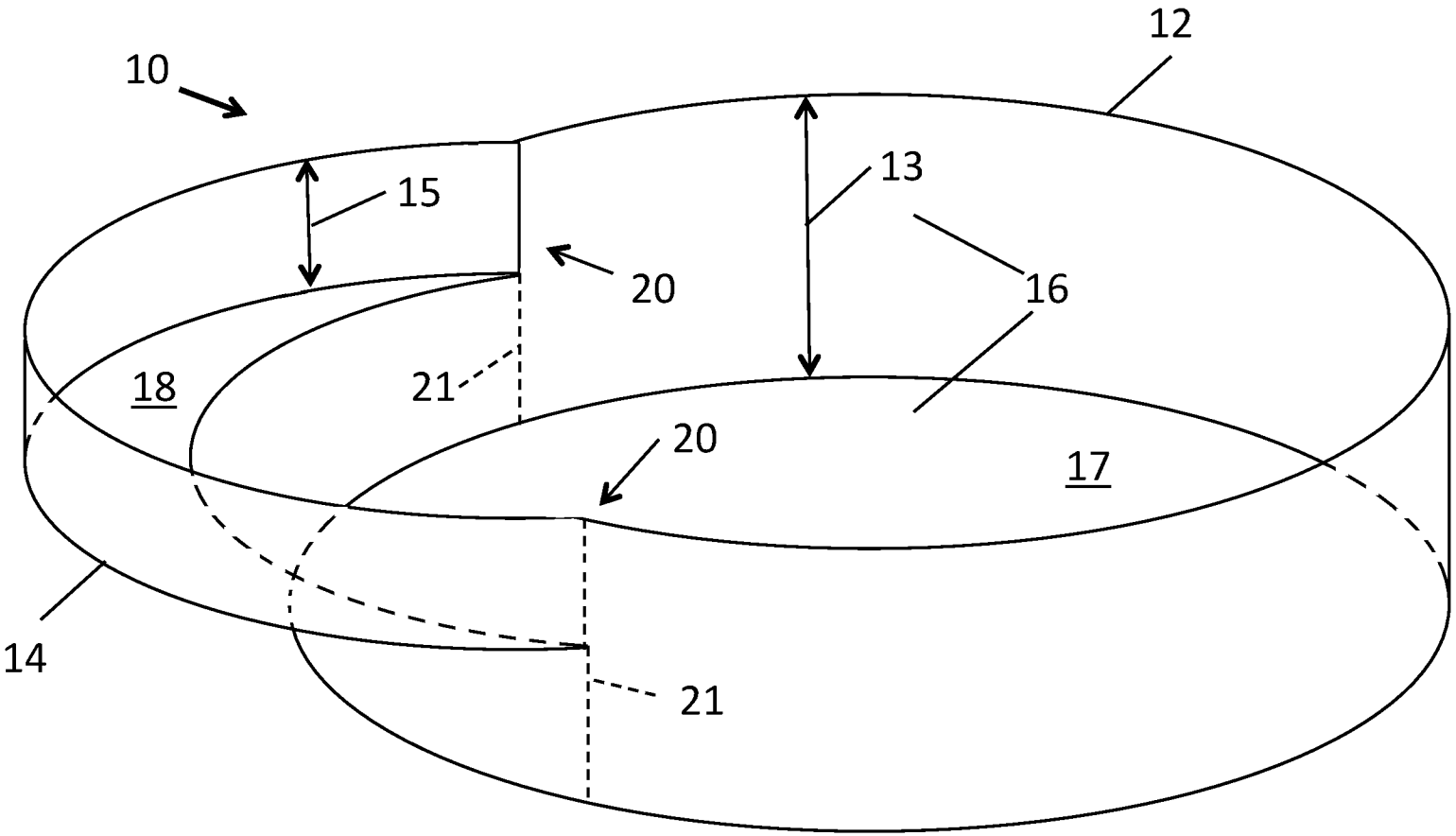
FIG. 1 is a perspective view of a pool assembly having an aspect of the present invention.

FIG. 1 is a schematic perspective view of a pool assembly 10 having an aspect of the present invention. Though aspects of the invention may be used in any type of pool assembly, for example, and in-ground pool, an above-ground pool, or a semi-above ground pool, for ease of illustration, the aspect shown in FIG. 1 illustrates a typical above-ground pool. For the pool assembly 1*o*, which is representative only and no way limiting to the various embodiments and aspects of the invention disclosed herein, includes a circular main pool portion or section 12 having a depth 13 and a shallower portion or section 14, for example, a "wading pool" or "wading section," having a shallower depth 15, though one or more shallower portions 14 may be provided. According to aspects of the invention, the wading pool or shallower portion 14 may contain pool water (not shown), for example, be contiguous with or in fluid communication with pool water (not shown) in main pool portion 12, or have little or no pool water, for example, having an elevation above the level of the pool water in section 12.

According to aspects of the invention, main pool portion 12 may comprise any conventional shaped pool, including generally circular (as shown), oval, rectangular, square, or polygonal, among the broad range of pool shapes known in the art. Also shallower portion 14 may also be generally circular (as shown), but may also be oval, rectangular, square, or polygonal in shape, among the broad range of pool shapes known in the art. Pool sections 12 and 14 may typically include a pool liner 16, for example, a conventional "vinyl" liner, shaped and dimensioned to conform to the shapes of pool portions 12 and/or 14 as is known in the art. However, in one aspect, no liner 16 may be provided, for example, pool 10 may comprise a concrete or gunite structure or surface directly contacted by the water in pool 10. As shown, pool portion 12 may typically include a base or floor 17 (for example, covered by liner 16) at depth 13, and shallower pool portion 14 may typically have a base or floor 18 (which may be covered by a liner 16) at depth 15, where base or floor 18 is positioned at an elevation above base or floor 17. In one aspect, floors 17 and 18, and other floors discloses herein, may be defined by a surface (for example, a sand surface, a gunite surface, or a concrete surface) covered by liner 16. In another aspect, floors 17 and 18 may not be covered by liner 16, but may comprise a concrete or gunite structure or surface directly contacted by the water in pool 10. As is conventional in the art, floors 17 and 18 may not have a uniform elevation or depths 13 and 15, respectively, or depths 13 and 15 may vary. In one aspect, floor 18 may be substantially level, that is, not vary substantially in depth. However, in other aspects, floor 17 may vary from a "shallow end" adjacent portion 14 to a "deep end" distal portion 14. Though in one aspect of the invention, the walls of sections 12 and 14 may preferably be defined by panels, as disclosed herein, in other aspects, sections 12 and 14, and other sections and surfaces disclosed herein, may be provided by concrete (for example, reinforced concrete), fiberglass (for example, molded fiberglass), metal for example, steel or aluminum), or combinations thereof.

According to aspects of the invention, pool assembly 10 includes at least one transition or junction 20 between portion 12 and portion 14 where depth 13 of portion 12 changes, for example, abruptly changes, from a first depth 13 of portion 12 to a second, shallower depth 15 of portion 14. In one aspect, this variation in depth may not be abrupt, but may vary from depth 13 to depth 15, for example, in a uniform linear or curvilinear fashion. According to aspects of the invention, a method and apparatus are provided for providing a structural support or junction 21 that accommodates the variation in depth of pool assembly 10 that facilitates construction, servicing, and maintenance of pool assembly 10.

Figure 2:
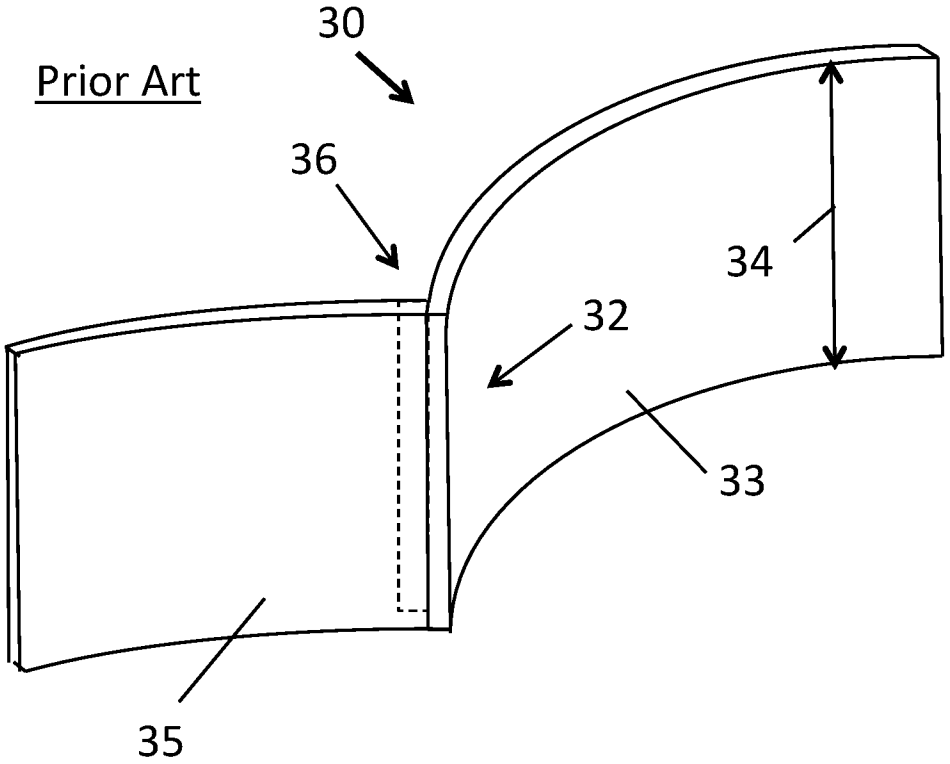
FIG. 2 is a perspective view of a portion of a pool having a surface junction according to the prior art.

FIG. 2 is a perspective view of a portion 30 of a pool having a junction 32 similar to junction 20 shown in FIG. 1 according to the prior art. For the sake of illustration, portion 30 is shown comprising a pool panel or pool support panel 33 defining a depth 34, for example, comparable to depth 13 shown in FIG. 1, and a pool panel or pool support panel 35 defining a similar depth 34. The typical pool liner and pool wall coping are omitted from FIG. 2 to facilitate illustration. According to the existing art, when a junction 32 is provided, panel 35 is typically positioned where an edge of panel 35 contacts or abuts a surface of panel 33, typically an external surface, and the panels are connected by mechanical fasteners, for example, plates and bolts.

Figure 3:
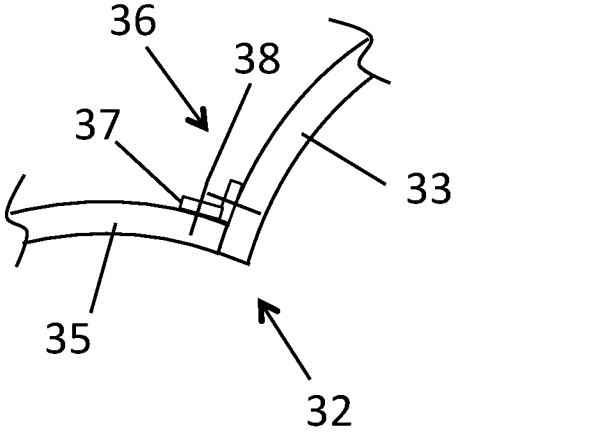
FIG. 3 is a partial top plan view of the prior art junction shown in FIG. 2.

FIG. 3 is a partial top plan view of the prior art junction 32 shown in FIG. 2. As shown, as is typical in the art, panel 35 is abutted with panel 33 and the panels are connected by means of one or more plates or gussets 37 and fasteners 38. For example, plate 37 may be an L-shaped structure having through holes positioned to receive screws 38 that penetrate and engage panels 33 and 35 as shown.

Though the junction 32 shown in FIGS. 2 and 3 can be an effective means of mounting panel 35 to panel 33, the need for one or more plates 37 and numerous fasteners 38 can be cumbersome during handling, installation, service, and maintenance. Moreover, the junction 32 shown can be especially cumbersome and inconvenient when constructing a junction between pool panels defining varying pool depths, for example, as shown in FIG. 1. Aspects of the present invention overcome these and other disadvantages of the prior art.

Figure 4:
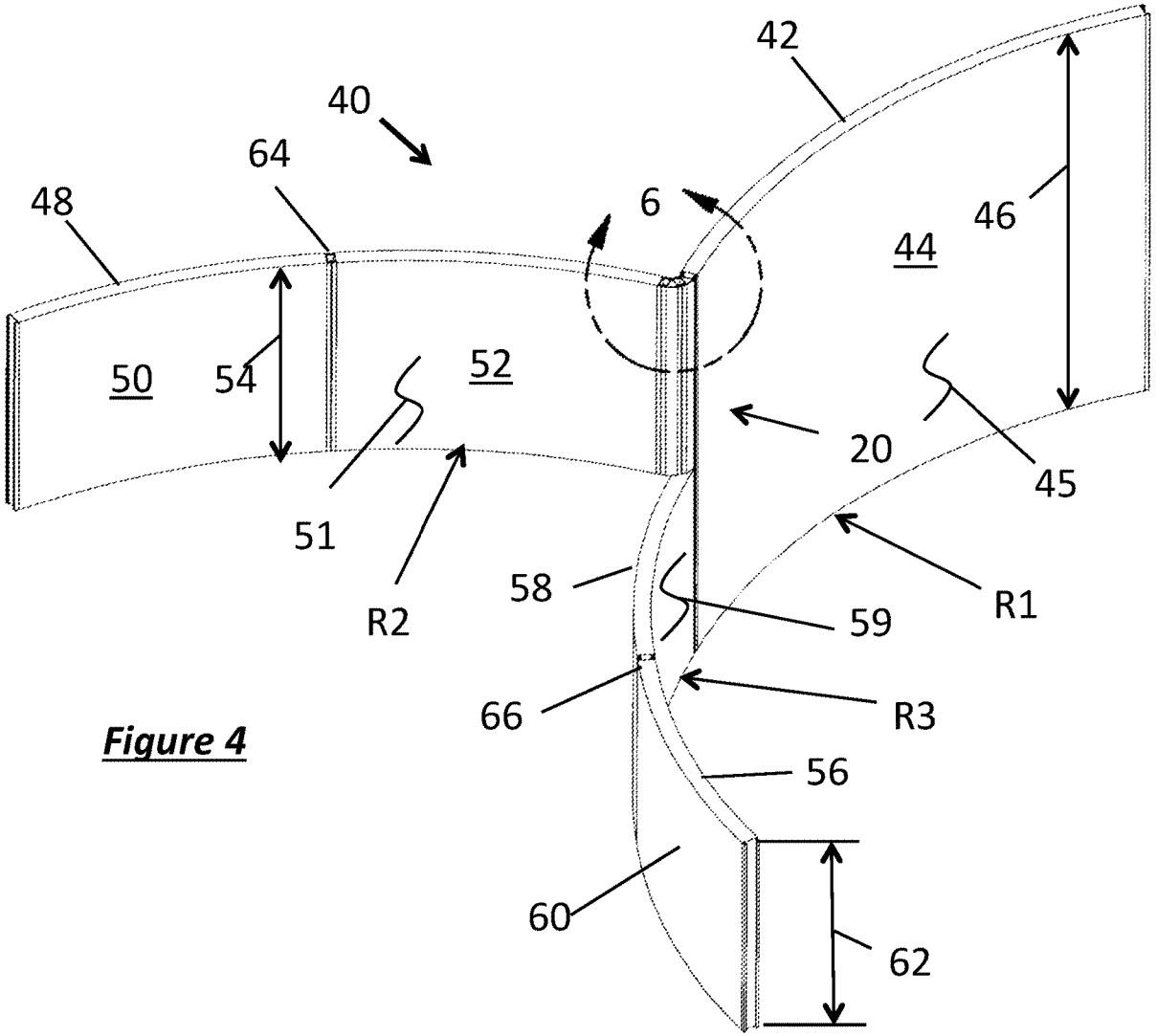
FIG. 4 is a perspective view of a portion of a pool having a surface junction according to one aspect of the present invention.
Figure 5:
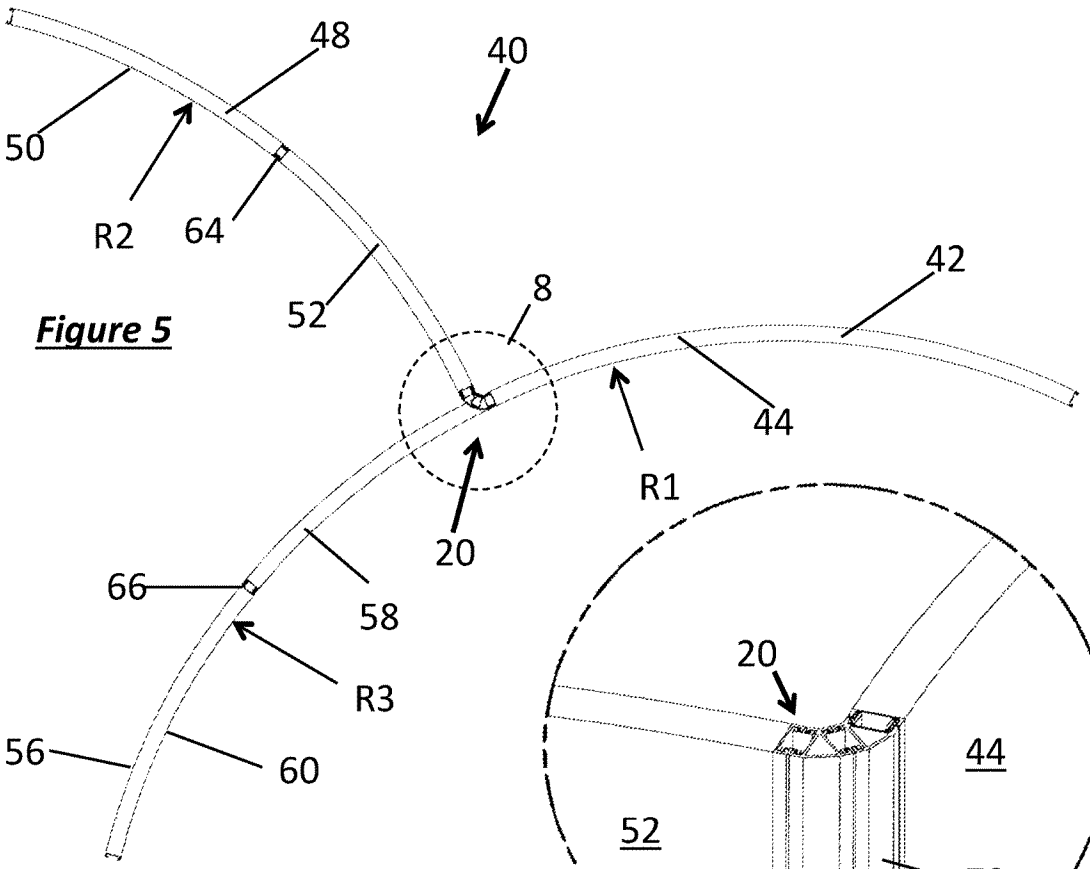
FIG. 5 is a top plan view of the portion of the pool shown in FIG. 4 according to one aspect of the invention.

FIG. 4 is a perspective view of a portion 40 of the pool 10 having a junction 20 as shown in FIG. 1 according to one aspect of the present invention. FIG. 5 is a top plan view of the portion 40 shown in FIG. 4. Again, the pool liner typically mounted over portion 40 and the pool wall coping mounted on the top of portion 40 are omitted from FIGS. 4 and 5 to facilitate illustration of aspects of the invention. Though not shown in FIGS. 4 and 5, portion 40, and other portions disclosed herein, may typically include bases or floors, such as, a floor 17 and a floor 18, as shown in FIG. 1. In a fashion similar to the pool construction shown in FIG. 1, aspects of the invention may be used in any type of pool assembly, for example, and in-ground pool, an aboveground pool, or a semi-above ground pool. The aspect shown in FIGS. 4 and 5 is illustrated as a typical above-ground pool portion 40 having a main pool portion or section 42, typically radiused, defined by one or more panels 44 defining a surface 45 having a depth 46 and a radius R1, which meets or transitions at junction 20 to a shallower portion or section 48, typically radiused, defined by panels 50 and 52 defining a surface 51 having a radius R2 and a shallower depth 54. One or more shallower portions 48 may be provided in a pool. As shown in FIGS. 4 and 5, the internal surface 45 of main portion 42 may typically meet, transition, or continue beyond junction 20 with a section 56 defined by panels 58 and 60 defining a surface 59 having a depth 62, for example, shallower than depth 46, and a radius R3.

The radii R1, R2, and R3 may vary broadly depending upon the size of the pool 10. In one aspect, radius R1 may range from about 2 feet to about 15 feet, for example, between about 5 feet and about 6 feet; radius R2 may range from about 2 feet to about 15 feet, for example, between about 6 feet and about 8 feet; and radius R3 may range from about 2 feet to about 15 feet, for example, between about 5 feet and about 6 feet. Though radius R1 defines a concave surface 45, radius R2 defines a concave surface 51, and radius R3 defines a concave surface 59 in FIGS. 4 and 5, any one or more of these surfaces may be concave or convex. In one aspect, one or more of surfaces 45, 51, and 59 may be substantially planar, for example, having a substantially infinite radius.

As illustrated most clearly in FIG. 1, according to aspects of the invention, shallower portion 48 shown in FIG. 4 of pool portion 40 may contain pool water (not shown), for example, shallower portion 48 may be in fluid communication with pool water in main pool portion 42 in FIGS. 4 and 5, or shallower portion 48 may have little or no pool water, for example, define an elevation above the level of the pool water in portions 42 and 56, for instance, having an elevation above elevation 62.

According to one embodiment of the invention, a pool 10 is provided having or comprising a first internal surface 45 having a first radius R1; a second internal surface 51 having a second radius R2; a third internal surface 59 having a third radius R3, different from the second radius; and a junction 20 where the first internal surface 44 transitions to the second internal surface 52 at a first elevation 62 and the first internal surface 45 transitions to the third internal surface 59 at a second elevation below elevation 62, different from the first elevation 62. In one aspect, at least one of the first internal surface 45, the second internal surface 51, and the third internal surface 59 may comprise an internal surface of a pool panel. In another aspect of the invention, at least one of the first internal surface 45, the second internal surface 51, and the third internal surface 59 may comprise an internal surface of any pool support structure, for example, a poured concrete or gunite foundation or a metal, plastic, or wooden frame or substructure, among other structures known in the art. As known in the art, a "vinyl" liner may cover surfaces 45, 51, and 59, though, in one aspect, no liner may be present.

According to one aspect of the invention, pool support panels 44, 50, 52, 58, 60, and any other pool enclosure disclosed herein may comprise composite panels, for example, pool panels having an insulating foam core captured by external sheets of metal or plastic. For example, in one aspect, pool support panels 44, 50, 52, 58, and 60 may be pool panels provided by Radiant Pools of Albany, N.Y., or their equivalent. For instance, pool support panels 44, 50, 52, 58, and 60 may be similar or substantially identical to the panels disclosed in U.S. Patent Publication 2008/0104745, which is incorporated by reference herein. Panel connectors 64 and 66 may interconnect pool support panels 44, 50, 52, 58, and 60. In one aspect panel connectors 64 and 66 may be any conventional connecting system or hardware, for example, mechanical fasters. In one aspect, panel connectors 64 and 66 may comprise panel connectors provided by Radiant Pools, for example, elongated connectors and cooperating connectors or "splines," as disclosed, for example, in Radiant Pool's "Inground Pool Installation Manual" (April 2014), which is incorporated by reference herein, though other types of panel connectors may be used.

According to aspects of the invention, pool portion 40 shown in FIGS. 4 and 5 of pool assembly 10 (in FIG. 1)

includes at least one transition or junction 20 between portion 42 and portions 48 and 56 where the depth 46 of portion 42 changes, for example, abruptly changes, from a first depth 46 of portion 42 to a second, shallower depth 54 of portion 48. In one aspect, this variation in depth may not be abrupt, but may vary from depth 13 to depth 15, for example, in a uniform linear or curvilinear fashion. According to aspects of the invention, a method and apparatus are provided which accommodate the geometric transition and provide structural support to junction 20 that accommodates the variation in depth of pool portion 40 (and pool assembly 10) and facilitates construction, servicing, and maintenance of pool assembly 10.

Figure 6:
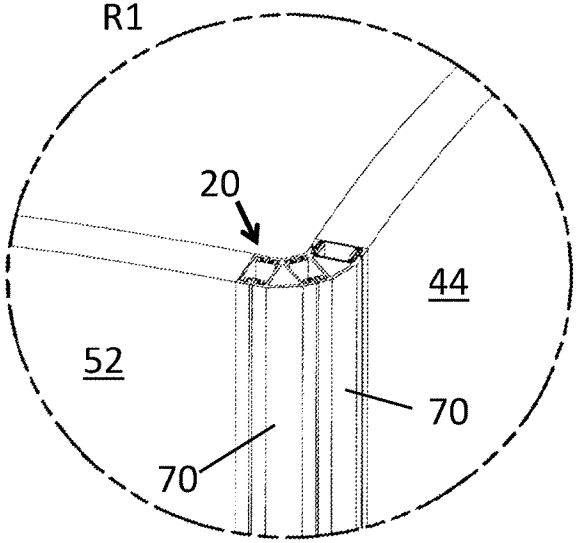
FIG. 6 is a detailed perspective view of junction shown in FIG. 4 as identified by Detail 6 in FIG. 4 according to one aspect of the invention.
Figure 7:
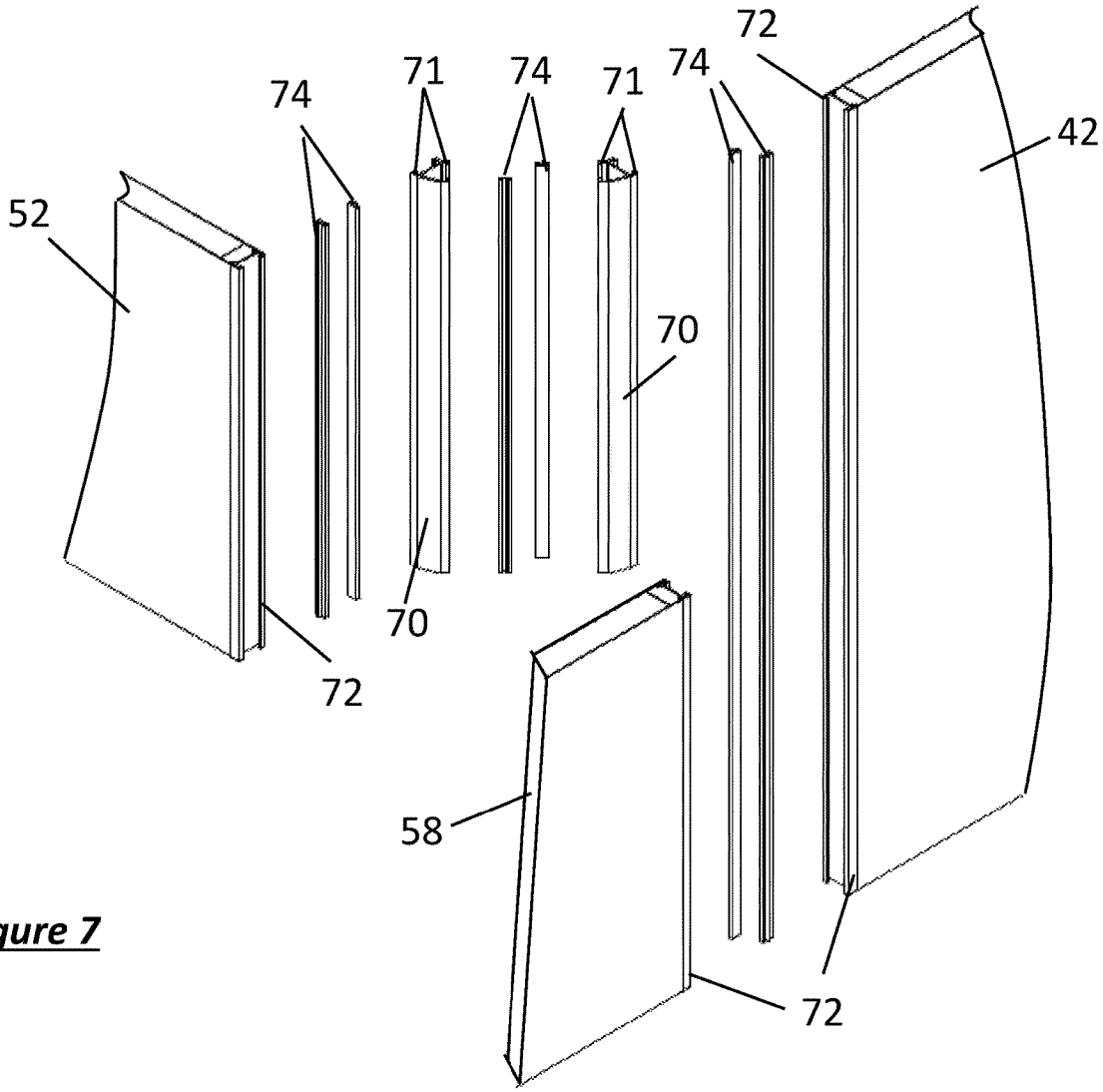
FIG. 7 is an exploded perspective view of the junction shown in FIG. 4 according to one aspect of the invention.
Figure 8:
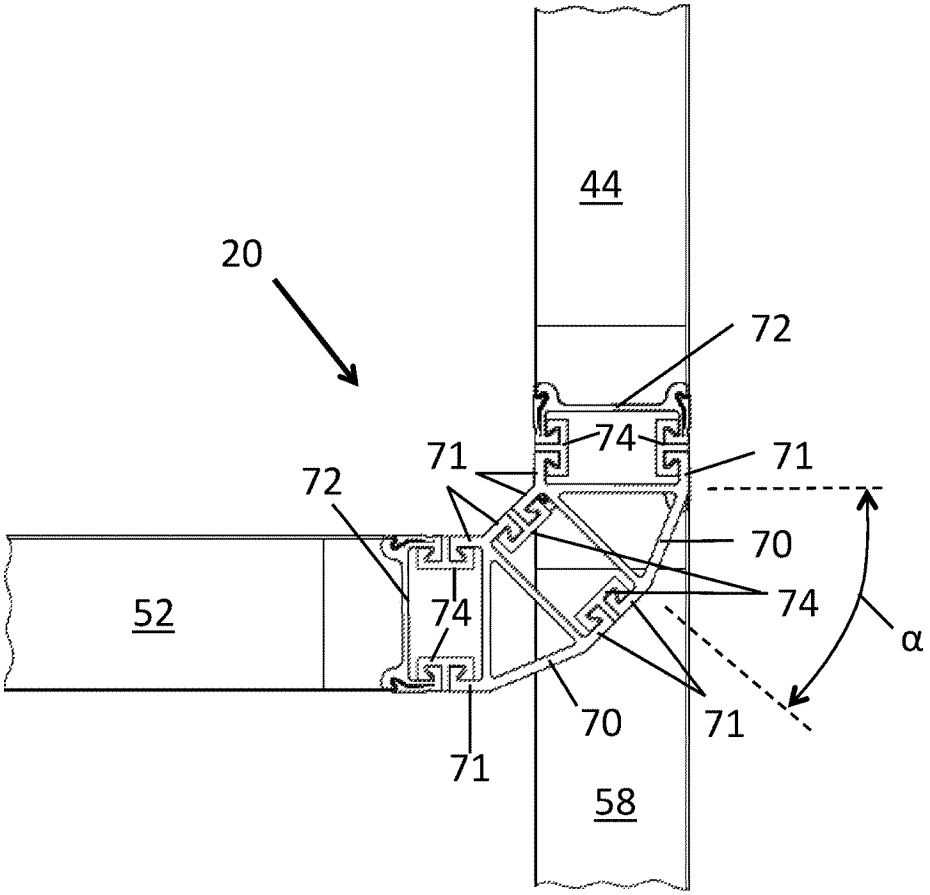
FIG. 8 is a detailed top plan view of the junction shown in FIG. 5 as identified by Detail 8 in FIG. 5 according to one aspect of the invention.

FIG. 6 is a detailed perspective view of junction 20 shown in FIG. 4 as identified by Detail 6 in FIG. 4 according to one aspect of the invention. FIG. 7 is an exploded perspective view, partially in cross section, of junction 20 shown in FIG. 4 according to one aspect of the invention. FIG. 8 is a detailed top plan view of junction 20 shown in FIG. 5 as identified by Detail 8 in FIG. 5 according to one aspect of the invention.

As shown in FIGS. 6, 7, and 8, according to one aspect of the invention, junction 20 comprises at least one, but typically, a plurality of, elongated structural members 70 having a generally triangular cross section. The number of elongated members 70 may vary depending upon the deviation in the direction of the path of panel 52 from the direction of the path of panel 44 and/or vary depending upon the width of panels 44 and 52. Though the cross sections of members 70 are shown generally triangular in shape, for example, isosceles triangular in shape, it is envisioned that the cross sectional shape of members 70 may also comprise truncated triangular shapes, for example, a trapezoidal shape, such as, an isosceles trapezoidal shape, or may comprises, in some aspects, a square or a rectangular cross section in shape.

According to aspects of the invention, structural members 70 are adapted to engage adjacent panels 44 and 52 and provide a geometric transition between the surface 45 of panel 44 and the surface 51 of panel 52, for example, to provide an appropriate generally continuous support for the liner (not shown) which is typically mounted to panels 44 and 52. As shown in FIG. 8, member 70 may have an apex angle $\alpha$ ranging from about 15 degrees to about 75 degrees, but may typically range from about 30 degrees to about 60 degrees, for example, about 45 degrees. In one aspect, as shown, a side of the triangular cross section of member 70 may have a length substantially the same as the width of the adjacent panels 44 and 52. In one aspect, the side of the triangular cross section of member 70 may range from about 0.5 inches to about 12 inches, but is typically between about 1 inch and about 5 inches, for example, about 2 inches.

In one aspect of the invention, structural members 70 may extend along the entire depth 46 (see FIG. 4) of panel 44, for example, when the depth 54 of panel 52 extends substantially to the depth 46 of panel 44. However, in the aspect shown in FIGS. 6, 7, and 8, the length of members 70 may extend substantially along the depth 54 of panel 52. In one aspect, the length of member 70 may range from about 4 inches to about 6 feet, but is typically between about 1 foot and about 3 feet, for example, about 2 feet.

Members 70 may be hollow as shown, for example, having one or longitudinal through holes or may be substantially solid, with little or no longitudinal holes.

Members 70 may be metallic or non-metallic, for example, member 70 may be made from iron, steel, stainless steel, aluminum, titanium, or any other structural metal. Members 70 may also be made of plastic, For example, a polyamide (PA), for example, nylon; a polyethylene (PE), both high-density polyethylene (HDPE) and low-density polyethylene (LDPE); a polyethylene terephthalate (PET); a polypropylene (PP); a polyester (PE); a polytetrafluoroethylene (PTFE); a polystyrene (PS); an acrylonitrile butadiene styrene (ABS); a polycarbonate (PC); or a polyvinylchloride (PVC); among other plastics. Members 70 may also be made of wood.

As shown most clearly in FIG. 8, members 70 typically engage adjacent panels 44 and 52 by conventional means, for example, with appropriate hardware, such as, mechanical fasteners. In the aspect of the invention shown in FIGS. 6, 7, and 8, members 70 engage adjacent panels 44 and 52 and adjacent members 70 by means of elongated connectors or splines 74, for example, the elongated connectors or splines similar or substantially identical to the elongated "splines" disclosed, for example, in Radiant Pool's "Inground Pool Installation Manual" (April 2014), which is incorporated by reference herein, though other types of elongated connectors may be used.

In one aspect of the invention, as shown most clearly in FIGS. 7 and 8, elongated splines 74 are adapted to engage elongated, complementary shaped connectors 71 and 72 mounted to panels 44 and 52 and to other members 70. For example, elongated splines 74 may typically include projections adapted to be received by, for example, slidably received by, and engaged with elongated recesses in connectors 71 and 72. Elongated connectors 72 may typically be mounted to panels 44 and 52 by conventional means. For example, when panels 44 and 52 comprise panels having metallic external metallic sheets, or "skins," connectors 72 may be mounted to panels 44 and 52 by rolling, for example, by deformation of the metallic sheets into structural engagement with connectors 72, thought other methods or fasteners may be used.

As also shown in FIGS. 7 and 8, triangular members 70 may also include elongated connectors 71, for example, substantially identical to elongated connectors 72, and also be adapted to receive and engage splines 74. In one aspect, elongated connectors 71 may be mounted to the sides of members 70, for example, by mechanical fasteners or welding. In another aspect, connectors 71 may be integral with members 70, for example, integrally formed during an extrusion process, to provide a generally triangular (or trapezoidal) shape and one or more connectors 71.

Figure 9:
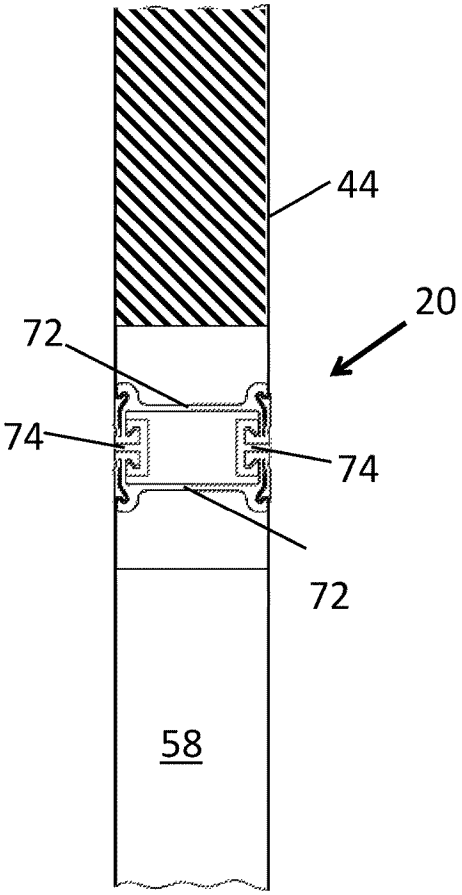
FIG. 9 is a detailed top plan view, similar to FIG. 8 and partially in cross section, of a lower portion of the junction shown in FIG. 5 according to one aspect of the invention.

FIG. 9 is a detailed top plan view, similar to FIG. 8 and partially in cross section, of a lower portion of the junction 20 shown in FIG. 5 according to one aspect of the invention. This lower portion of junction 20 illustrates one connection between panels 44 of pool portion 42 with panel 58 of pool portion 56. As shown, panel 44 may engage panel 58 in a fashion similar to the engagement of panel 44 with panel 52 shown in FIG. 8, though other methods may be used. Though junction 20 shown in FIG. 9 may include one or more triangular members 70 as shown in FIG. 8 (for example, when the orientation or direction of panel 58 deviates from the orientation or direction of panel 44), in the aspect shown in FIG. 8, no triangular members 70 are present. Specifically, in this aspect, an elongated connector 72 mounted to panel 44, for example, by rolling, may be mounted to elongated connector 72 mounted to panel 58, for example, by rolling, by means of elongated splines 74. In one aspect, elongated splines 74 and the elongated connector 72 mounted to panel 44 in the lower portion of junction 20 shown in FIG. 9 may be the same elongated splines 74 and elongated connector 72 shown in the upper portion of junction 20 shown in FIG. 8. However, in other aspects, these splines 74 and connector 72 may be separate, distinct elements.

Figure 10:
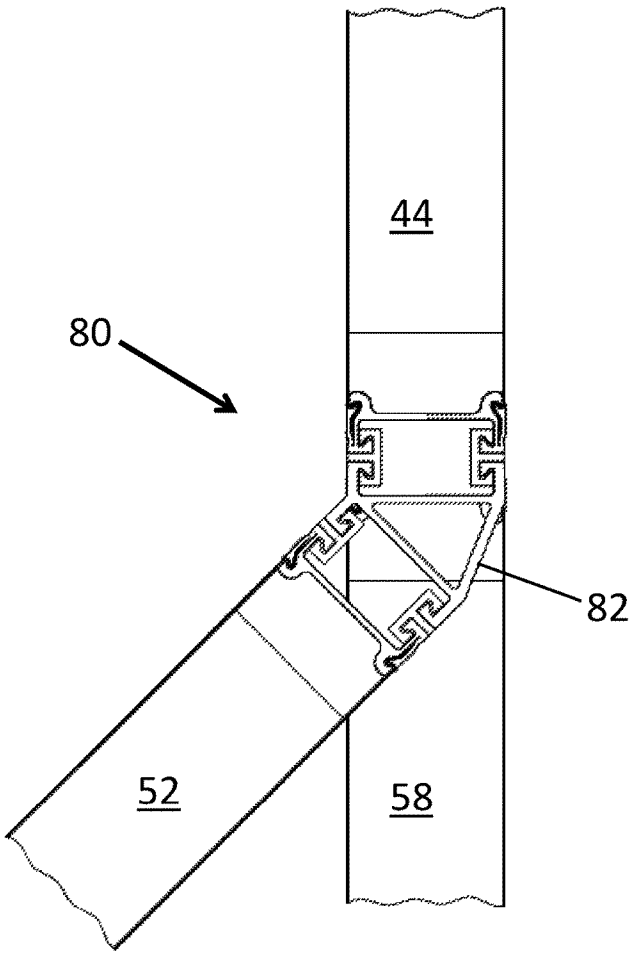
FIG. 10 is a detailed top plan view, similar to FIG. 8, of the junction shown in FIG. 5 according to another aspect of the invention.

FIG. 10 is a detailed top plan view, similar to FIG. 8, of a junction 80 shown that may be used for junction 20 shown in FIG. 5 according to another aspect of the invention. In this aspect, junction 80 includes a single triangular elongated member 82. Member 82 may have all the properties of elongated member 70 described above. For example, member 82 may be trapezoidal, hollow, metallic, and have one or more elongated connectors adapted to engage elongated splines, as disclosed herein.

Figure 11:
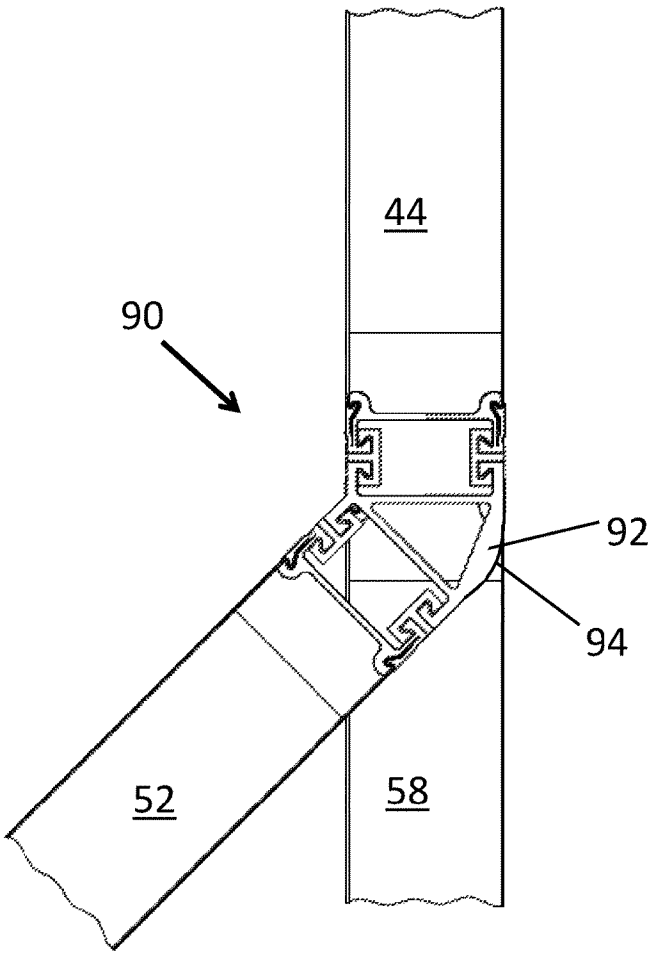
FIG. 11 is a detailed top plan view, similar to FIG. 10, of the junction shown in FIG. 5 according to a further aspect of the invention.

FIG. 11 is a detailed top plan view, similar to FIG. 10, of a junction 90 according to a further aspect of the invention. In this aspect, junction 90 includes a single triangular elongated member 92, though two or more members 92 may be provided, having a radiused surface 94. The radius of radiused surface 94 may vary depending upon the size and orientation of pool 10 and size and orientation of panels 44 and 52, among other factors. Member 92 may have all the properties of elongated member 70 described above. For example, member 92 may be trapezoidal, hollow, metallic, and have one or more elongated connectors adapted to engage elongated splines, as disclosed herein.

FIG. 12 is a perspective view, similar to FIG. 4, of a portion 100 of a pool having a surface junction 110 according to another aspect of the present invention. FIG. 13 is a top plan view of portion 100 of the pool shown in FIG. 12 according to one aspect of the invention. Again, the pool liner typically mounted over portion 100 and the pool wall coping mounted on the top of portion 100 are omitted from FIGS. 12 and 13 to facilitate illustration of aspects of the invention. In a fashion similar to the pool construction shown in FIG. 1, aspects of the invention may be used in any type of pool assembly, for example, and in-ground pool, an aboveground pool, or a semi-above ground pool. The aspect shown in FIGS. 12 and 13 is illustrated as a typical aboveground pool portion 100 having a main pool portion or section 102, typically radiused, defined by one or more panels 104 defining a surface 105 having a depth 106 and a radius R11, which meets or transitions at junction 110 to two or more shallower portions or sections 112 and/or 113, typically radiused. Section 112 is defined by one or more panels 115 and 116 defining a surface 117 and a depth 118, shallower than depth 106, and a radius R12. Section 113 is defined by one or more panels 120 and 122 defining a surface 121 and a depth 124 and a radius R13. One or more shallower sets of portions 112 and/or 113 may be provided in a pool. Though two shallower portions 112 and 113 may be provided as shown FIGS. 12 and 13, in one aspect, 3 or more portions 112 and 113 or, 4 or more portions 112 and 113 may be provided, for example, in a fashion providing numerous changes in depth or elevation, for example, providing steps, or a stair assembly, or multiple seats or seating surfaces, among other structures.

As shown in FIGS. 12 and 13, the internal surface 105 of main portion 102 may typically meet, transition, or continue beyond junction 110 with a section 114 defined by panels 126 and 128 defining a surface 127 having a depth 130, for example, shallower than depth 106, and a radius R14. In one aspect, radius R14 may be substantially the same as radius R11 of section 102.

According to aspects of the invention, junction 110 shown in FIGS. 12 and 13 may comprise multiple different junctions or transitions having varying lengths and inclusive angles, for example, as shown in FIGS. 6 through 11. For example, in one aspect, junction 110 may include first junction 110A transitioning from surface 105 to surface 117; a second junction 110B transitioning between surface 105 to surface 121; and at least one third junction 110C transitioning between surface 105 to surface 127. FIG. 14 is a detailed top plan view junction 110 shown in FIGS. 12 and 13 as identified by Detail 14 in FIG. 13 according to one aspect of the invention. In one aspect, junctions 110A, 110B, and at least 110C may comprise a single component, for example, a single component accommodating the variations in orientation and/or direction exemplified by the aspect shown in FIGS. 12, 13, and 14. However, in other aspects of the invention, junctions 110A, 110B, and at least 110C may comprise individual distinct components, for example, comprising one or more triangular spacers 170 having connectors 171 designed to engage splines 174, for example, similar in design and construction to spacers 70, connectors 71, and splines 74 disclosed herein, as shown in FIGS. 6 through 11. For example, in one aspect, junction 110A may comprise one or more triangular spacers 170 having a first length and a first angle $\alpha$ (see FIG. 8); junction 110B may comprise one or more triangular spacers 170 having a second length and a second angle $\alpha$; and junction 110C may comprise one or more triangular spacers 170 having a third length and a third angle $\alpha$. The first, second, and third lengths of spacers 170 of junctions 110A, 110B, and 110C may be substantially the same or they may vary, for example, within the ranges of length of spacer 70 disclosed above. The first, second, and third angle $\alpha$ of spacer 170 of junctions 110A, 110B, and 110C may be substantially the same or they may vary, for example, within the ranges of angle $\alpha$ of spacer 70 disclosed above.

The radii R11, R12, R13, and R14 may vary broadly depending upon the size of the pool 10, for example, have similar ranges of dimension as radii R1, R2, and R3, disclosed above. Though radius R11 defines a concave surface 105, radius R12 defines a concave surface 117, radius R13 defines a concave surface 121, and radius R14 defines a concave surface 127 in FIGS. 12 and 13, any one or more of these surfaces may be concave or convex. In one aspect, one or more of surfaces 105, 117, 121, and/or 137 may be substantially planar, for example, having a substantially infinite radius.

As illustrated most clearly in FIG. 1, according to aspects of the invention, shallower portions 112 and/or 113 shown in FIGS. 12 and 13 of pool portion 100 may contain pool water (not shown), for example, shallower portions 112 and/or 113 may be in fluid communication with pool water in main pool portion 102, or shallower portion 112 or 113 may have little or no pool water, for example, defining an elevation above the level of the pool water in portion 102.

According to one embodiment of the invention, a pool 10 is provided having or comprising or consisting of a first internal surface 105 having a first radius R11; a second internal surface 117 having a second radius R12; a third internal surface 121 or 127 having a third radius R13 or R14, different from the second radius R12; and a junction 110 where the first internal surface 105 transitions to the second internal surface 116 at a first elevation 118 and the first internal surface 105 transitions to the third internal surface 121 or 127 at a second elevation 124 or 130, below elevation 106. In one aspect, at least one of the first internal surface 105, the second internal surface 117, and the third internal surface 121 or 127 may comprise an internal surface of a pool panel, as disclosed herein. In another aspect of the invention, at least one of the first internal surface 105, the second internal surface 117, and the third internal surface 121 or 127 may comprise an internal surface of any pool support structure, for example, a poured concrete or gunite foundation or a metal, plastic, fiberglass, or wooden frame or substructure, among other structures known in the art. As known in the art, a "vinyl" liner may cover surfaces 105, 117, 121 and 127, though, in one aspect, no liner may be present.

Figure 15:
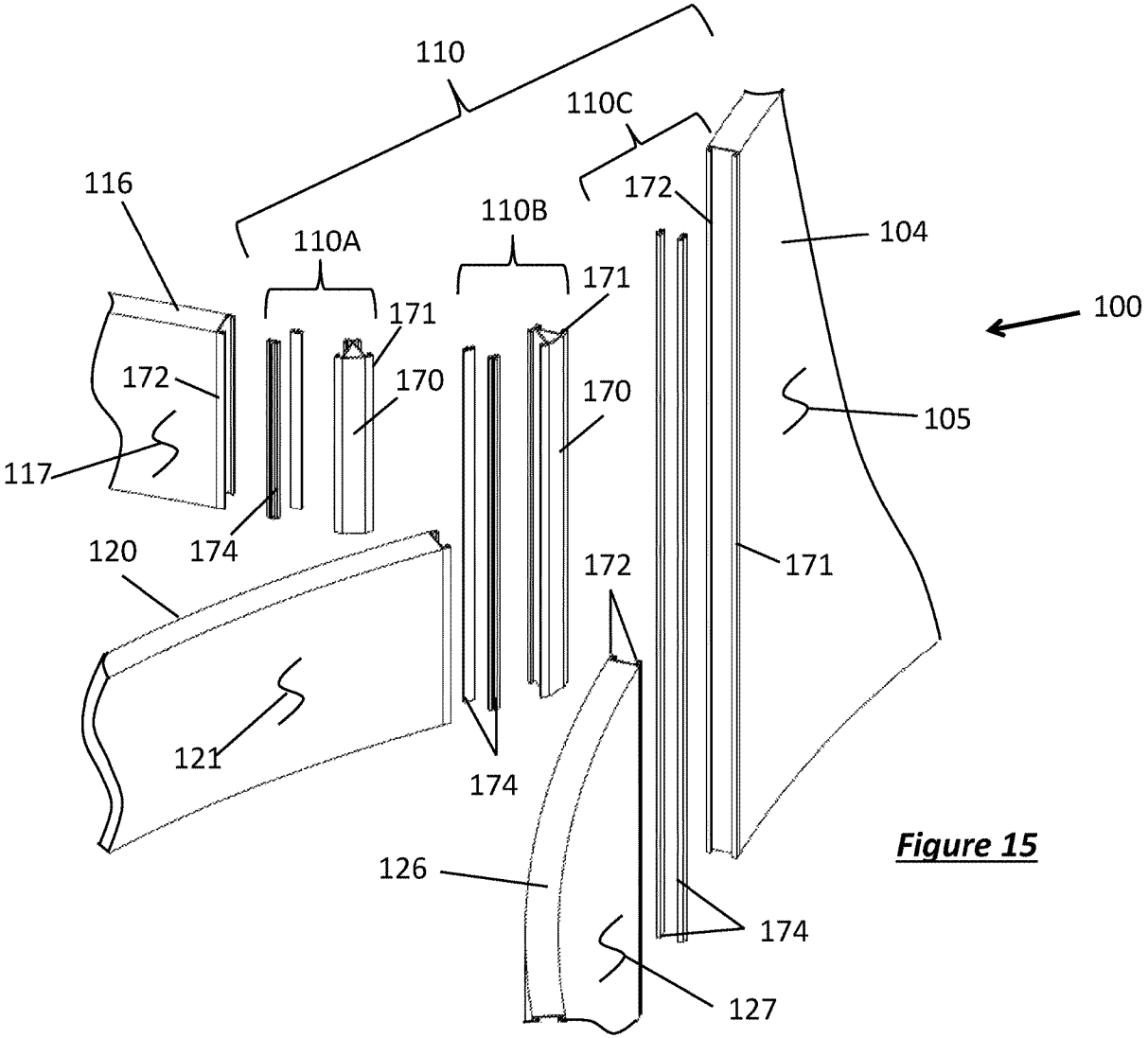
FIG. 15 is a partial exploded perspective view of the junction shown in FIGS. 12, 13, and 14 according to one aspect of the invention.

FIG. 15 is a partial exploded perspective view of the junction 110 shown in FIGS. 12, 13, and 14 according to one aspect of the invention. As shown in FIG. 15, according to one aspect of the invention, junction 110 comprises at least one, but typically, a plurality of, elongated structural members 170 having a generally triangular cross section. The number and apex angle (a, see FIG. 8) of elongated members 170 may vary depending upon the deviation in the direction of the path of panel 104 from the direction of the path of panels 116 and/or panel 120 and/or pane 126, and/or vary depending upon the width of panels 116 and/or 120 and/or 126. Though the cross sections of members 170 are shown generally triangular in shape in FIGS. 14 and 15, for example, isosceles triangular in shape, it is envisioned that the cross sectional shape of members 170 may also comprise truncated triangular shapes, for example, a trapezoidal shape, such as, an isosceles trapezoidal shape, or may comprises, in some aspects, a square or a rectangular cross section in shape.

According to aspects of the invention, structural members 170 are adapted to engage adjacent panels 116, 120, and 126 and provide a geometric transition between the surface 105 of panel 104 and the surface 117 of panel 116, between the surface 105 of panel 104 and the surface 121 of panel 120, and/or between the surface 105 of panel 104 and the surface 127 of panel 126 to provide an appropriate generally continuous support for the surfaces and/or the liner (not shown) which is typically mounted to panels 104. 116, 120, and 127, among others. Members 170 may have an apex angle $\alpha$, as shown in FIG. 8, ranging from about 15 degrees to about 75 degrees, but may typically range from about 30 degrees to about 60 degrees, for example, about 45 degrees. Members 170 may also be sized and shaped in a manner similar to member 70 disclosed herein, for example, having a triangular cross section having a with substantially the same as the width of the adjacent panels 104, 116, 10, and 126, for instance, about 2 inches.

In one aspect of the invention, structural members 170 may extend along the entire depth 106 (see FIG. 12) of panel 104. However, in the aspect shown in FIGS. 12, 13, 14, and 15, the length of members 170 may extend substantially along the depth 118 of panel 116 and/or depth 124 of panel 120. In one aspect, the length of member 170 may range in a fashion similar to member 70 disclosed herein, for example, about 2 feet.

Members 170 may be hollow as shown, for example, having one or longitudinal through holes or may be substantially solid, with little or no longitudinal holes.

Members 170 may made from any one or more of the materials from which member 70 may be made, for example, members 170 may be metallic or non-metallic.

As shown most clearly in FIGS. 14 and 15, members 170 typically engage adjacent panels 104, 116, 120, and 126 by conventional means, for example, with appropriate hardware, such as, mechanical fasteners. In the aspect of the invention shown in FIGS. 12 through 15, members 170 engage adjacent panels 104, 116, 120, and 126 and adjacent members 170 by means of elongated connectors or splines 174, for example, the elongated connectors or splines similar or substantially identical to the elongated "splines" disclosed, for example, in Radiant Pool's "Inground Pool Installation Manual" (April 2014), which is incorporated by reference herein, though other types of elongated connectors may be used.

In one aspect of the invention, as shown most clearly in FIGS. 14 and 15, elongated splines 174 are adapted to engage elongated, complementary shaped connectors 171 and 172 mounted to panels 104, 116, 120, and 126 and to other members 170. For example, elongated splines 174 may typically include projections adapted to be received by, for example, slidably received by, and engaged with elongated recesses in connectors 171 and 172. Elongated connectors 172 may typically be mounted to panels 104, 116, 120, and 126 by conventional means. For example, when panels 104, 116, 120, and 126 comprise panels having metallic external metallic sheets, or "skins," connectors 172 may be mounted to panels 104, 116, 120, and 126 by rolling, for example, by deformation of the metallic sheets into structural engagement with connectors 172, thought other methods or fasteners may be used.

As also shown in FIGS. 14 and 15, triangular members 170 may also include elongated connectors 171, for example, substantially identical to elongated connectors 172, and also be adapted to receive and engage splines 174. In one aspect, elongated connectors 171, in a fashion similar to connectors 71, may be mounted to the sides of members 170, for example, by mechanical fasteners or welding. In another aspect, connectors 171 may be integral with members 170, for example, integrally formed during an extrusion process or related process, to provide a generally triangular (or trapezoidal) shape and one or more connectors 171.

Figures 16, 17:
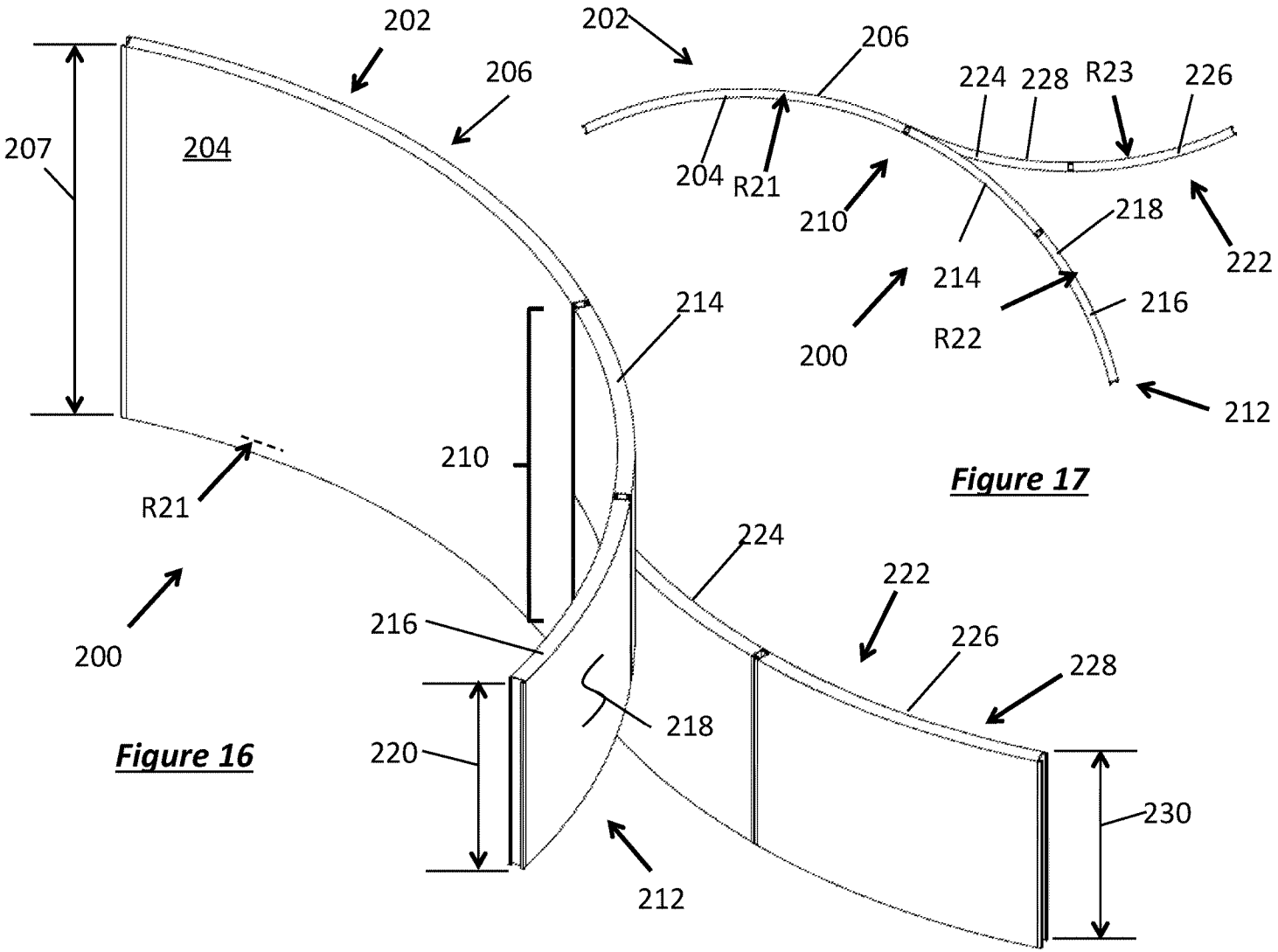
FIG. 16 is a perspective view of a portion of a pool having a surface junction according to another aspect of the present invention.
FIG. 17 is a top plan view of the portion of the pool shown in FIG. 16.

FIG. 16 is a perspective view of a portion 200 of a pool 10 (see FIG. 1) having a surface junction 210 according to another aspect of the present invention. FIG. 17 is a top plan view of portion 200 of the pool shown in FIG. 16. Again, the pool liner typically mounted over portion 200 and the pool wall coping mounted on the top of portion 200 are omitted from FIGS. 16 and 17 to facilitate illustration of aspects of the invention. Though not shown in FIGS. 16 and 17, portion 200, and other portions disclosed herein, may typically include bases or floors, such as, a floor 17 and a floor 18, as shown in FIG. 1. In a fashion similar to the pool construction shown in FIG. 1, aspects of the invention shown in FIGS. 16 and 17 may be used in any type of pool assembly, for example, and in-ground pool, an aboveground pool, or a semi-above ground pool. The aspect shown in FIGS. 16 and 17 is illustrated as a typical above-ground pool portion 200 having a main pool portion or section 202, typically radiused, defined by one or more panels 204 defining a surface 206 having a depth 207 and a radius R21, which meets or transitions at junction 210 to a shallower portion or section 212, typically radiused, defined by one or more panels 214 and 216 defining a surface 218 having a radius R22 and a depth 220, shallower than depth 207. One or more shallower portions 212 may be provided in a pool 10.

As shown in FIGS. 16 and 17, the internal surface 206 of main portion 202 may typically meet, transition, or continue beyond junction 210 with a section 222 defined by one or more panels 224 and 226 defining a surface 228 having a depth 230, for example, shallower than depth 207, and a radius R23.

The radii R21, R22, and R23 may vary broadly depending upon the size of the pool 10, for example, having range of length disclosed for radii R1, R2, and R3, disclosed herein. Though radius R21 defines a convex surface 206, radius R22 defines a convex surface 218, and radius R23 defines a concave surface 228 in FIGS. 16 and 17, any one or more of these surfaces may be concave or convex. In one aspect, one or more of surfaces 206, 218, and 228 may be substantially planar, for example, having a substantially infinite radius.

As illustrated most clearly in FIG. 16, according to aspects of the invention, shallower portion 212 shown in FIGS. 16 and 17 of pool portion 200 may contain pool water (not shown), for example, shallower portion 212 may be in fluid communication with pool water in main pool portion 202 in FIGS. 16 and 7, or shallower portion 212 may have little or no pool water, for example, define an elevation above the level of the pool water in portions 212 and 222, for instance, having an elevation above elevation 230.

According to one embodiment of the invention, a pool 10 having a pool portion 200 is provided having or comprising or consisting of a first internal surface 206 having a first radius R21; at least one second internal surface 218 having a second radius R22; a third internal surface 228 having a third radius R23, different from the second radius R22; and a junction 210 where the first internal surface 206 transitions to one or more of the second internal surface 218 at a first depth or elevation 220 and the first internal surface 206 transitions to the third internal surface 228 at a second depth or elevation 230 below depth or elevation 220, different from a first depth or elevation 207. In one aspect, at least one of the first internal surface 206, the second internal surface 218, and the third internal surface 228 may comprise an internal surface of a pool panel, for example, an insulated panel provided by Radiant Pools, as disclosed herein. In another aspect of the invention, at least one of the first internal surface 204, the one or more second internal surface 218, and the third internal surface 228 may comprise an internal surface of any pool support structure, for example, a poured concrete or gunite foundation or a metal, plastic, fiberglass, or wooden frame or substructure, among other structures known in the art. As known, in the art, a "vinyl" liner may cover surfaces 206, 218, and 228, though, in one aspect, no liner may be present.

According to aspects of the invention, pool portion 200 shown in FIGS. 16 and 17 of pool assembly 10 (in FIG. 1) includes at least one transition or junction 210 between portion 202 and one or more portions 212 and portion 222 where the depth 207 of portion 202 changes, for example, abruptly changes, from a first depth 205 of portion 202 to a second, shallower depth 220 of portion 212. In one aspect, this variation in depth may not be abrupt, but may vary from depth 207 to depth 220, for example, in a uniform linear or curvilinear fashion.

According to aspects of the invention, a method and apparatus are provided which accommodate the geometric transition and provide structural support to junction 210 that accommodates the variation in depth of pool portion 200 (and pool assembly 10) and facilitates construction, servicing, and maintenance of pool assembly 10.

According to one aspect of the invention, pool support panels 204, 214, and 224 of junction 210 of pool portion 200 in FIGS. 16 and 17 may comprise composite panels, for example, pool panels having an insulating foam core captured by external sheets of metal or plastic. For example, in one aspect, pool support panels 204, 214, and 224 may be pool panels provided by Radiant Pools of Albany, N.Y., or their equivalent, as disclosed herein. In one aspect panels 204, 214, and 224 of junction 210 may be engaged or connected by any conventional connecting system or hardware, for example, mechanical fasters. However, in one aspect, panel panels 204, 214, and 224 of junction 210 may be engaged with panel connectors similar to those disclosed in FIGS. 6 and 7 and 14 and 15, with or without triangular connectors 70 and 71. In one aspect, panel panels 204, 214, and 224 of junction 210 may be engaged or connected by elongated connectors and cooperating connectors or "splines," as disclosed, for example, in Radiant Pool's "Inground Pool Installation Manual" (April 2014), which is incorporated by reference herein, though other types of panel connectors may be used.

It will be apparent from the foregoing that the invention, in its many aspects, provides devices, systems, and methods for pools, pool construction, pool wall junctions, and construction members. Where prior art methods and devices for pool construction may be adequate, aspects of the present invention facilitate pool installation, servicing, and maintenance, while providing pool geometries and designs, in particular, wading pools, that heretofore were not possible.

In addition to pools, for example, backyard swimming pools, aspects of the invention may also be employed in spas, exercise pools, physical therapy pools, tubs, or any water-containing enclosure that may benefit from the function, ease of installation, and aesthetic appearance of aspects of the present invention. Other aspects of the invention may be used along shorelines, for example, along the shore of a lake, pond, river, or even along an ocean shore or beach.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "including," and/or "having" when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical applications, and to enable others of ordinary skill in the art to understand the disclosure for various embodiments with various modifications as are suited to the particular use contemplated.

This written description uses examples to disclose the invention, including the best mode envisioned, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A pool comprising:

an internal surface of a first panel having a first radius;

an internal surface of a second panel having a second radius;

an internal surface of a third panel having a third radius, different from the second radius; and a junction comprising at least one elongated structural member adapted to operatively engage the first panel and the second panel at a first elevation, and wherein the internal surface of the first panel transitions to the internal surface of the third panel at a second elevation, less than the first elevation.

2. The pool as recited in claim 1, wherein the elongated structural member comprises a length substantially equal to a depth of the second panel.

3. The pool as recited in claim 1, wherein the elongated structural member comprises a pair of opposing sides defining planes that converge at an apex.

4. The pool as recited in claim 3, wherein the elongated structural member comprises a triangular cross section.

5. The pool as recited in claim 3, wherein the pair of opposing sides each includes a mechanical fastener.

6. The pool as recited in claim 5, wherein the mechanical fastener comprises a pair of opposing recesses, each of the recesses adapted to receive a projection from a connector.

7. The pool as recited in claim 6, wherein the connector comprises an elongated spline having a pair of opposing projections.

8. The pool as recited in claim 1, wherein each of the first panel, the second panel, and the third panel comprises a panel having an insulating foam core and external sheets.

9. The pool as recited in claim 1, wherein the at least one elongated structural B member operatively engages only the first panel and the second panel.

10. The pool as recited in claim 1, wherein the at least one elongated structural member is further adapted to operatively engage the first panel and the third panel.

11. A method of fabricating a pool, the method comprising:

providing a first panel having an internal surface having a first radius;

mating a second panel having an internal surface having a second radius with the internal surface of the first panel at a junction at a first elevation with at least one elongated structural member; and mating a third panel having an internal surface having a third radius, different from the second radius, with the internal surface of the first panel at the junction at a second elevation less than the first elevation with the at least one elongated structural member.

12. The method as recited in claim 11, wherein mating the second panel with the first panel at the junction comprises engaging the first panel and the second panel with a pair of opposing sides of the elongated member, the opposing sides defining planes that converge at an apex between the first panel and the second panel.

13. The method as recited in claim 12, wherein engaging the first panel and the second panel comprises slidably engaging a first elongated connector between the first panel and the at least one elongated structural member and slidably engaging a second elongated connector between the second panel and the at least one elongated structural member.

14. The method as recited in claim 11, wherein each of the first panel, the second panel, and the third panel comprises a pool panel having an insulating foam core and external sheets.

15. A pool comprising:

a first insulated panel having a first internal surface having a first radius;

a second insulated panel having a second internal surface having a second radius;

a third insulated panel having a third internal surface having a third radius, different from the second radius; and a junction where the first internal surface of the first insulated panel transitions to the second internal surface of the second insulated panel at a first elevation and the first internal surface of the first insulated transitions to the third internal surface of the third insulated panel at a second elevation, less than the first elevation;

wherein the junction comprises at least one elongated structural member having sides adapted to operatively engage the first insulated panel and the second insulted panel; and wherein the sides of the at least one elongated structural member define planes that converge at an apex.

16. The pool as recited in claim 15, wherein the at least one elongated structural member comprises a triangular cross section.

17. The pool as recited in claim 15, wherein the sides the at least one elongated structural member each include a mechanical fastener.

18. The pool as recited in claim 17, wherein the mechanical fastener comprises a pair of opposing recesses, each of the opposing recesses adapted to receive a projection from a connector.

19. The pool as recited in claim 18, wherein the connector comprises an elongated spline having a pair of opposing projections.

20. The pool as recited in claim 15, wherein the sides of the at least one elongated structural member define planes that converge at an apex angle from 30 to 60 degrees.

21. The pool as recited in claim 15, wherein the at least one elongated structural member comprises a trapezoidal cross section.

22. The pool as recited in claim 15, wherein the at least one elongated structural member further comprises a radiused surface adapted to conform the first internal surface to the second internal surface.

23. The pool as recited in claim 15, wherein each of the first insulated panel, the second insulated panel, and the third insulated panel comprises a panel having an insulating foam core and external sheets.

* * * * *